US012185802B2

(12) United States Patent
Luo

(10) Patent No.: US 12,185,802 B2
(45) Date of Patent: Jan. 7, 2025

(54) SNAP-IN CRANK MECHANISM

(71) Applicant: Tempo Manufacturing LLC, Nantong (CN)

(72) Inventor: Xiong Luo, Nantong (CN)

(73) Assignee: Tempo Manufacturing LLC, Nantong (CN)

( * ) Notice: Subject to any disclaimer, the term of this patent is extended or adjusted under 35 U.S.C. 154(b) by 134 days.

(21) Appl. No.: 18/043,685

(22) PCT Filed: Jul. 6, 2021

(86) PCT No.: PCT/CN2021/104616
§ 371 (c)(1),
(2) Date: Mar. 1, 2023

(87) PCT Pub. No.: WO2022/048298
PCT Pub. Date: Mar. 10, 2022

(65) Prior Publication Data

US 2023/0292893 A1 Sep. 21, 2023

(30) Foreign Application Priority Data

Sep. 7, 2020 (CN) ..... 202021938332.1

(51) Int. Cl.
*A45B 25/14* (2006.01)

(52) U.S. Cl.
CPC ..... *A45B 25/14* (2013.01)

(58) Field of Classification Search
CPC ..... A45B 25/14
See application file for complete search history.

(56) References Cited

U.S. PATENT DOCUMENTS

| | | | | |
|---|---|---|---|---|
| 5,884,859 | A * | 3/1999 | Ma | A45B 25/14 242/395 |
| 6,182,917 | B1 * | 2/2001 | Lai | A45B 25/14 242/395 |
| 6,196,489 | B1 * | 3/2001 | Ma | A45B 25/14 242/395 |
| 6,230,724 | B1 * | 5/2001 | Lai | A45B 25/14 242/395 |
| 6,591,848 | B2 * | 7/2003 | Ma | A45B 25/14 135/22 |
| 6,631,728 | B2 * | 10/2003 | Liu | A45B 25/14 135/20.3 |
| 6,722,381 | B2 * | 4/2004 | Lai | A45B 25/14 242/395 |
| 6,871,659 | B2 * | 3/2005 | Tung | A45B 19/04 135/20.3 |
| 2014/0182640 | A1 * | 7/2014 | Tung | A45B 17/00 135/20.3 |
| 2022/0248819 | A1 * | 8/2022 | Luo | A45B 25/14 |

* cited by examiner

*Primary Examiner* — Noah Chandler Hawk
(74) *Attorney, Agent, or Firm* — Wang Law Firm, Inc.

(57) ABSTRACT

A snap-in crank mechanism has a crank housing mounted out of a column, and a crank having a crank rod with two ends; the crank housing has a crank inner housing sleeved outside the column, and a crank outer housing detachably sleeved outside the crank inner housing; the crank inner housing has a left inner housing, a right inner housing and a lower inner housing, the crank outer housing is slidable on the periphery of a sleeve formed by the left inner housing and the right inner housing.

7 Claims, 4 Drawing Sheets

SNAP-IN CRANK MECHANISM

TECHNICAL FIELD OF THE INVENTION

The invention relates to the technical field of an umbrella, in particular to a snap-in crank mechanism.

BACKGROUND OF THE INVENTION

As an outdoor leisure appliance, umbrellas are widely used in square, beach, park, courtyard and other leisure places, providing people with comfortable cool space. The structure for the present umbrella is generally composed of a pole, a rib frame and a canopy, wherein the rib frame is connected to the top of the pole, the pole mainly plays a role in supporting the rib frame, and the canopy is connected to the rib frame. When the rib frame is unfolded, the canopy is also unfolded, so that the umbrella is unfolded. The umbrella has different shading areas in different application scenarios. Large umbrellas used outdoor are generally large and high, and are usually folded or unfolded by manual pushing, pulling ropes, using cranks, etc.

There is a great deal of mechanism for the present umbrella, but in most instances, two plastic housings are connected by screws. As a result, the screw mounting holes are exposed, and it is impossible to replace other styles of housings in the same state. In addition, the crank heads for the present umbrella are mostly made of metal or ordinary plastics, so that the user experience is greatly affected.

Therefore, it is urgent to design a new crank mechanism, which is aesthetic in appearance, replaceable with many types of housings and comfortable to hold and can improve the product quality and the user experience.

SUMMARY OF THE INVENTION

It is an object of the present invention is to provide a snap-in crank mechanism, which is reasonable in structure, easy to disassemble and assemble, aesthetic in appearance and replaceable with many types of housings and can improve the user's comfort in use.

For achieving the above object: a snap-in crank mechanism is provided, including a crank housing mounted out of a column and a crank having a crank rod with two ends; a crank head and a crank shaft; wherein, the crank housing comprises a crank inner housing sleeved outside the column, and a crank outer housing detachably sleeved outside the crank inner housing; the crank inner housing has a left inner housing, a right inner housing and a lower inner housing, the left inner housing and the right inner housing are connected with each other forming a sleeve which is sleeved outside the column and has a crank rod mounting hole at the periphery of the sleeve; the crank outer housing is slidable on the periphery of the sleeve formed by the left inner housing and the right inner housing; the lower inner housing is inserted from the bottom of the crank outer housing, and is located between the crank outer housing and the bottom of the left inner housing and the right inner housing clamping with the left inner housing and the right inner housing; one end of the crank rod is located inside the crank rod mounting hole and is connected to the crank shaft running through the column, while the other end of the crank rod is connected to the crank head.

Preferably, each of the left inner housing and the right inner housing is a semi-cylindrical shelf; the left inner housing has an upper and lower portion, a plurality of connecting columns are protruding from the inner surface of the upper and lower portions of the left inner housing; the right inner housing correspondingly has a plurality of counter bores for receiving each connecting column, so that the left inner housing and the right inner housing are connected with each other and secured by a self-tapping screw and sleeved outside the column.

Preferably, the crank outer housing is a cylinder having an opening at the top and the end of the crank outer housing, the detail structure that the crank outer housing is slidable on the periphery of the left inner housing is: the crank outer housing has an upward U-shaped slot; and each of the left inner housing and the right inner housing has a covered channel for guiding and receiving the edge of the U-shaped slot of the crank outer housing, each covered channel locates at the periphery of the left inner housing and the right inner housing and at the side of the crank rod mounting hole, being a guiding channel for the crank outer housing to slide on and be positioned with the left inner housing and the right inner housing.

Preferably, the sleeve of the left inner housing and the right inner housing has a lower reduced diameter section for receiving the lower inner housing, and the sleeve of the left inner housing and the right inner housing has a plurality of buckles protruding at the lower reduced diameter section; the lower inner housing has a plurality of clamping holes at the inner surface of the lower inner housing, each buckle clamps to a clamping hole so as to make the lower inner housing secured to the left inner housing and the right inner housing; the lower inner housing has a bottom flange at the bottom of the lower inner housing for pressing against the bottom edge of the crank outer housing.

Preferably, each of the left inner housing and the right inner housing has two buckles, the lower inner housing has four clamping holes; each the left inner housing and the right inner housing has a top flange, and the top of the crank outer housing resists against the top flange, the crank outer housing is positioned between the top flange and the bottom flange.

Preferably, the column has a through hole for receiving the crank shaft transversely formed on the column corresponding to the position of the crank rod mounting hole of the crank inner housing; one end of the crank shaft is square, the crank rod has a square hole for receiving the square end of the crank shaft, and the other end of the crank shaft has a plurality of external threads connected to a ratchet; a plane bearing is disposed on the crank shaft between the crank rod and the column, and the crank shaft is driven to rotate under the rotation of the crank rod.

Preferably, two mushroom heads are respectively sheathed on two ends of the through hole of the column; the plane bearing is sheathed on the crank shaft between one mushroom head and the crank rod; a slide stopping gasket is disposed between the other mushroom head and the ratchet.

Finally, the crank head consists of a liner made of plastics and a jacket made of natural rubber; the liner has a connecting counter bore running through the liner, and the crank rod correspondingly has an internal thread hole at the bottom thereof; a blanking cover is sheathing on the outer end of the connecting counter bore; the crank head is mounted on the crank rod by passing a bolt through the connecting counter bore and screwing it into the internal thread hole.

Compared with the prior art, the present invention has the following advantages. The crank housing comprises a crank inner housing and a crank outer housing; the crank inner housing has a left inner housing, a right inner housing and a lower inner housing; the crank outer housing is detachably sleeved outside the left inner housing and the right inner housing; the lower inner housing can be connected and fixed when each buckle clamps to a clamping hole. During disassembly, only if the lower inner housing is pulled down, it is convenient to replace different styles of housings, so that the appearance aesthetics is improved, and it is convenient for production, assembly and shape variation. The jacket of the crank head is made of natural rubber, so it is more comfortable to hold when in use. The present invention is simple and reasonable in structure and aesthetic in appearance, and can satisfy the requirement of replacing many types of housings, improve the user's comfort in use and improve the production quality and the user experience.

DETAILED DESCRIPTION OF THE INVENTION

The present invention will be further described in detail with reference to the accompanying drawings by embodiments.

Figure 1:
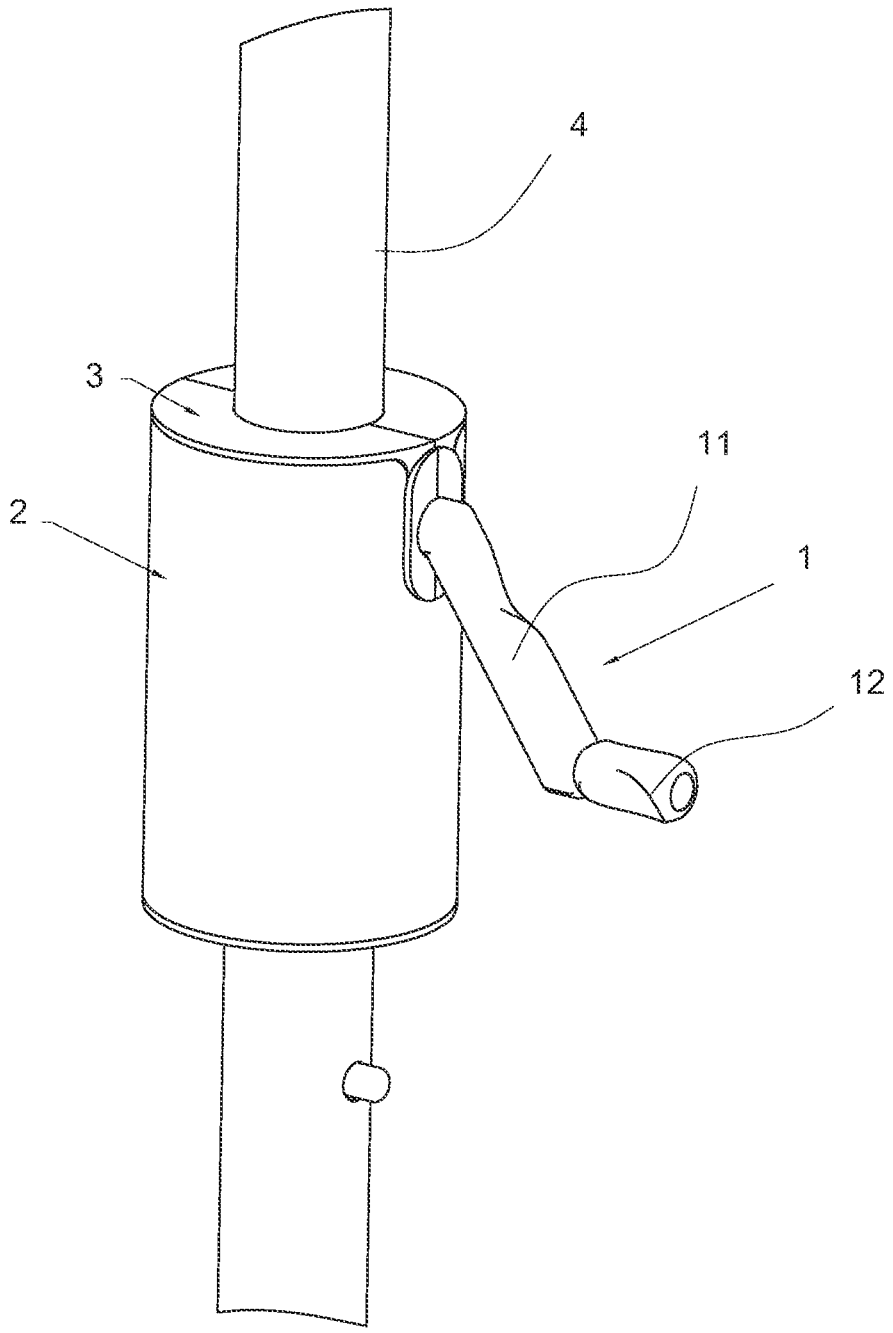
FIG. 1 is a perspective view of a snap-in crank mechanism for an umbrella according to an embodiment of the present invention.
Figure 2:
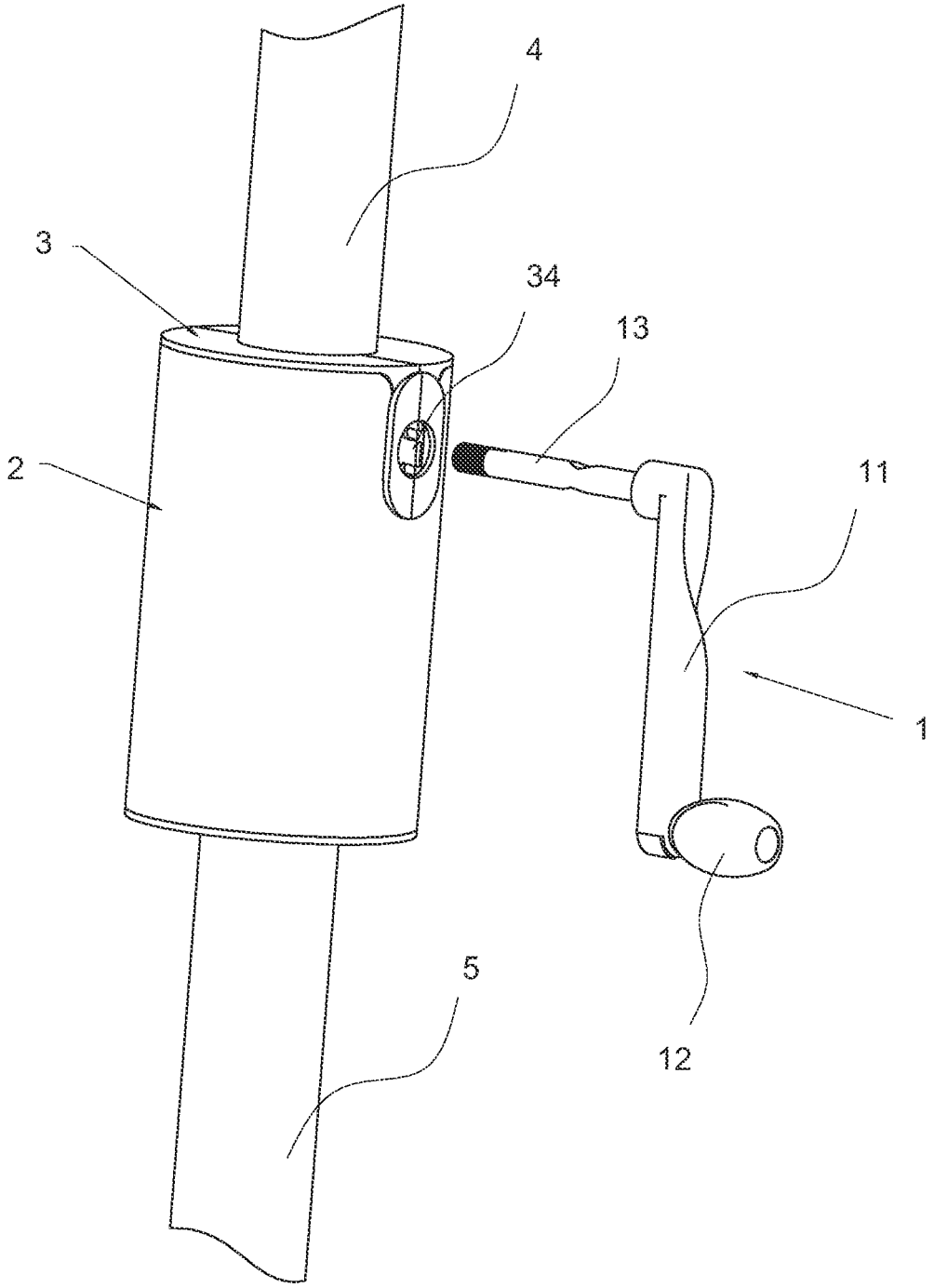
FIG. 2 is a perspective view of the crank and the crank outer housing which are not connected to each other.
Figure 3:
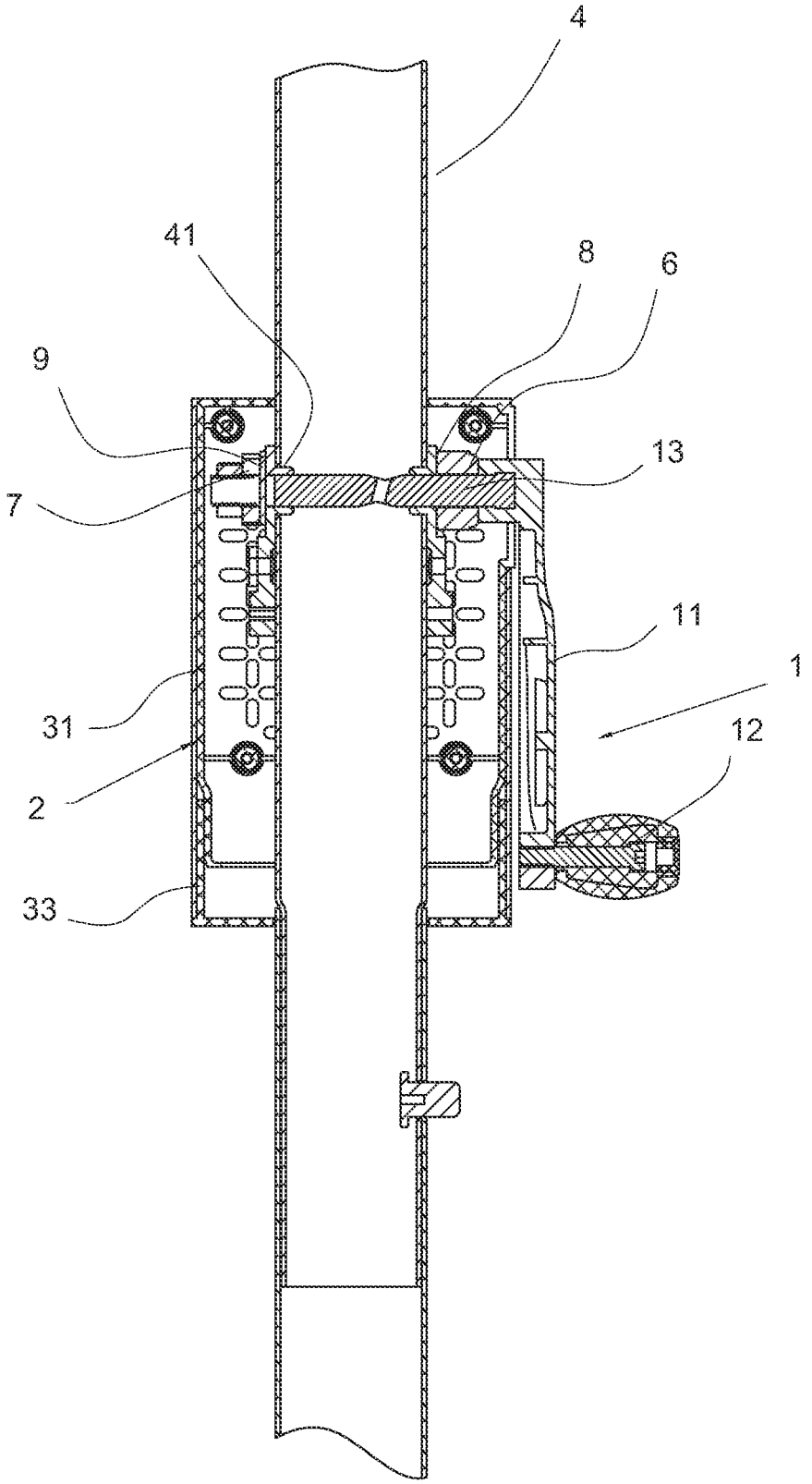
FIG. 3 is a longitudinally sectional view of FIG. 1.
Figure 4:
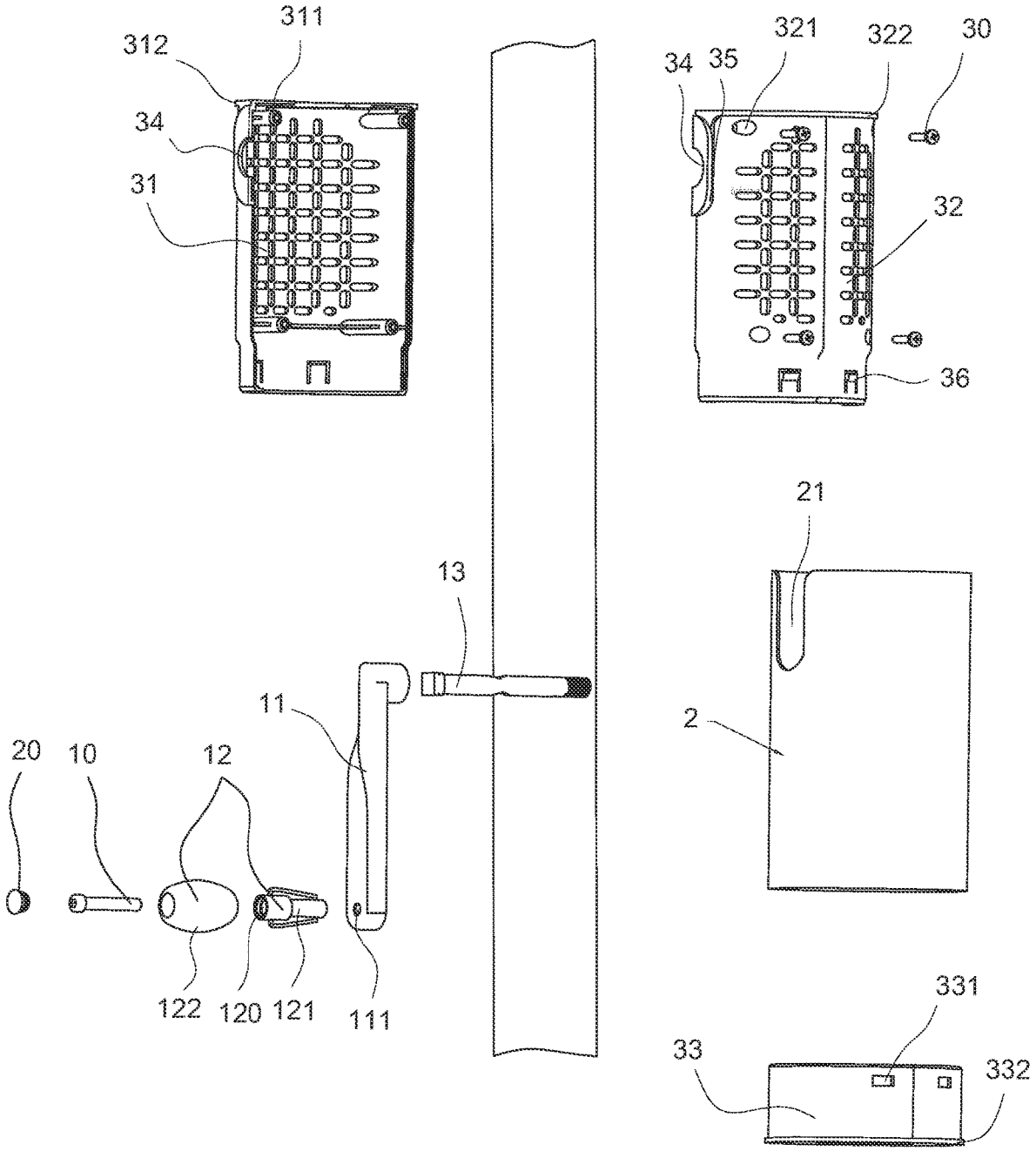
FIG. 4 is an exploded view of FIG. 1.

As shown in FIGS. 1-4, a snap-in crank mechanism comprises a crank housing mounted out of a column 4, and a crank 1 having a crank rod 11 with two ends, a crank head 12 and a crank shaft 13. The crank housing comprises a crank inner housing 3 sleeved outside the column 4, and a crank outer housing 2 detachably sleeved outside the crank inner housing 3; the crank inner housing 3 has a left inner housing 31, a right inner housing 32 and a lower inner housing 33, the left inner housing 31 and the right inner housing 32 are connected with each other forming a sleeve which is sleeved outside the column 4 and has a crank rod mounting hole 34 at the periphery of the sleeve; the crank outer housing 2 is slidable on the periphery of the sleeve formed by the left inner housing 31 and the right inner housing 32; the lower inner housing 33 is inserted from the bottom of the crank outer housing 2, and is located between the crank outer housing 2 and the bottom of the left inner housing 31 and the right inner housing 32 clamping with the left inner housing 31 and the right inner housing 32; the lower inner housing 33 has a bottom flange 332 at the bottom of the lower inner housing 33 for pressing against the bottom edge of the crank outer housing 2; one end of the crank rod 11 is located inside the crank rod mounting hole 34 and is connected to the crank shaft 13 running through the column 4, while the other end of the crank rod 11 is connected to the crank head 12; the jacket of the crank head is made of natural rubber.

The specific structure is as follows: each of the left inner housing 31 and the right inner housing 32 is a semi-cylindrical shelf; the left inner housing 31 has an upper and lower portion, a plurality of connecting columns 311 are protruding from the inner surface of the upper and lower portions of the left inner housing 31; the right inner housing 32 correspondingly has a plurality of counter bores 321 for receiving each connecting column 311, so that the left inner housing 31 and the right inner housing 32 are connected with each other and secured by a self-tapping screw 30 and sleeved outside the column 4; the crank outer housing 2 is a cylinder having an opening at the top and the end of the crank outer housing 2, the detail structure that the crank outer housing 2 is slidable on the periphery of the left inner housing 31 is: the crank outer housing 2 has an upward U-shaped slot 21; and each of the left inner housing 31 and the right inner housing 32 has a covered channel 35 for guiding and receiving the edge of the U-shaped slot 21 of the crank outer housing 2, each covered channel 35 locates at the periphery of the left inner housing 31 and the right inner housing 32 and at the side of the crank rod mounting hole 34; each the left inner housing 31 and the right inner housing 32 has a top flange 312, 322; each covered channel 35 is a guiding channel for the crank outer housing 2 to slide on and be positioned with the left inner housing 31 and the right inner housing 32; the edge of crank outer housing 2 is pressed against the top flange 312, 322. Of course, guide fitting structure may also be additionally provided between the lower inner housing 33 and the left inner housing 31 and the right inner housing 32 and between the lower inner housing 33 and the crank outer housing 2, as required. The sleeve of the left inner housing 31 and the right inner housing 32 has a lower reduced diameter section for receiving the lower inner housing 33, and the sleeve of the left inner housing 31 and the right inner housing 32 has a plurality of buckles 36 protruding at the lower reduced diameter section; the lower inner housing 33 has a plurality of clamping holes 331 at the inner surface of the lower inner housing 33, each buckle 36 clamps to a clamping hole 331 so as to make the lower inner housing 33 secured to the left inner housing 31 and the right inner housing 32; each of the left inner housing 31 and the right inner housing 32 has two buckles 36, the lower inner housing 33 has four clamping holes 331; so that the crank outer housing 2 is sleeved outside the crank inner housing 3, and the crank outer housing 2 is positioned between the top flange 312, 322 and the bottom flange 332. For the convenience of assembly and disassembly, in this embodiment, the crank housing is mounted in the lower part of the column 4 near the connection with a lower section 5.

The column 4 has a through hole 41 for receiving the crank shaft 13 transversely formed on the column 4 corresponding to the position of the crank rod mounting hole 34 of the crank inner housing 3; one end of the crank shaft 13 is square, the crank rod 11 has a square hole for receiving the square end of the crank shaft 13, and the other end of the crank shaft 13 has a plurality of external threads connected to a ratchet 7; two mushroom heads 8 as bush are respectively sheathed on two ends of the through hole 41 of the column 4; a plane bearing 6 is disposed on the crank shaft 13 between the crank rod 11 and the column 4, and the crank shaft 13 is driven to rotate under the rotation of the crank rod 11; a slide stopping gasket 9 is disposed between the other mushroom head 8 and the ratchet 7. The operation principle of the crank 1 is the same as that in the prior art and will be repeated here.

The crank head 12 consists of a liner 121 made of plastics and a jacket 122 made of natural rubber; the liner 121 has a connecting counter bore 120 running through the liner 121, and the crank rod 11 correspondingly has an internal thread hole 111 at the bottom thereof; a blanking cover 20 is sheathing on the outer end of the connecting counter bore 120; the crank head 12 is mounted on the crank rod 11 by passing a bolt 10 through the connecting counter bore 120 and screwing it into the internal thread hole 111.

When it is necessary to replace the crank outer housing 2, we only need to separate the lower section 5 from the column 4, and take down the lower inner housing 33, it is easy to take down the crank outer housing 2 for replacement. Different types of crank outer housings 2 may be replaced as required, thereby improving the aesthetics. During mounting, the crank outer housing 2 is sleeved outside the left inner housing 31 and the right inner housing 32 from bottom to top through guide fitting, and the lower inner housing 33 is clamped for positioning from bottom, so that it is very convenient.

Moreover, since the jacket 122 of the crank head 12 is made of natural rubber, it is more conformable to hold when in use, and the product quality and the user experience are improved.

The protection scope of the present invention is not limited to each embodiments described in this description. Any changes and replacements made on the basis of the scope of the present invention patent and of the description shall be included in the scope of the present invention patent.

The invention claimed is:

1. A snap-in crank mechanism comprising a crank housing mounted out of a column, and a crank having a crank rod with two ends, a crank head and a crank shaft;

wherein, the crank housing comprises a crank inner housing sleeved outside the column, and a crank outer housing detachably sleeved outside the crank inner housing;

the crank inner housing has a left inner housing, a right inner housing and a lower inner housing, the left inner housing and the right inner housing are connected with each other forming a sleeve which is sleeved outside the column and has a crank rod mounting hole at the periphery of the sleeve;

each of the left inner housing and the right inner housing is a semi-cylindrical shelf;

the crank outer housing is slidable on the periphery of the sleeve formed by the left inner housing and the right inner housing;

the left inner housing has an upper and lower portion, a plurality of connecting columns protrude from the inner surface of the upper and lower portions of the left inner housing;

the right inner housing correspondingly has a plurality of counter bores for receiving each connecting column, so that the left inner housing and the right inner housing are connected with each other and secured by a self-tapping screw and sleeved outside the column;

the lower inner housing is inserted from the bottom of the crank outer housing, and is located between the crank outer housing and the bottom of the left inner housing and the right inner housing clamping with the left inner housing and the right inner housing;

one end of the crank rod is located inside the crank rod mounting hole and is connected to the crank shaft running through the column, while the other end of the crank rod is connected to the crank head.

2. The crank mechanism of claim 1, wherein the crank outer housing is a cylinder having an opening at the top and the end of the crank outer housing, the crank outer housing is slidable on the periphery of the left inner housing;

wherein the crank outer housing has an upward U-shaped slot;

and each of the left inner housing and the right inner housing has a covered channel for guiding and receiving the edge of the U-shaped slot of the crank outer housing, each covered channel locates at the periphery of the left inner housing and the right inner housing and at the side of the crank rod mounting hole, being a guiding channel for the crank outer housing to slide on and be positioned with the left inner housing and the right inner housing.

3. The crank mechanism of claim 2, wherein the sleeve of the left inner housing and the right inner housing has a lower reduced diameter section for receiving the lower inner housing, and the sleeve of the left inner housing and the right inner housing has a plurality of buckles protruding at the lower reduced diameter section;

the lower inner housing has a plurality of clamping holes at the inner surface of the lower inner housing, each buckle clamps to a clamping hole so as to make the lower inner housing secured to the left inner housing and the right inner housing;

the lower inner housing has a bottom flange at the bottom of the lower inner housing for pressing against the bottom edge of the crank outer housing.

4. The crank mechanism of claim 3, wherein each of the left inner housing and the right inner housing has two buckles; the lower inner housing has four clamping holes;

each of the left inner housing and the right inner housing has a top flange, and the top of the crank outer housing resists against the top flange, the crank outer housing is positioned between the top flange and the bottom flange.

5. The crank mechanism of claim 1, wherein the column has a through hole for receiving the crank shaft transversely formed on the column corresponding to the position of the crank rod mounting hole of the crank inner housing;

one end of the crank shaft is square, the crank rod has a square hole for receiving the square end of the crank shaft, and the other end of the crank shaft has a plurality of external threads connected to a ratchet;

a plane bearing is disposed on the crank shaft between the crank rod and the column, and the crank shaft is driven to rotate under the rotation of the crank rod.

6. The crank mechanism of claim 5, wherein two mushroom heads are respectively sheathed on two ends of the through hole of the column;

the plane bearing is sheathed on the crank shaft between one mushroom head and the crank rod;

a slide stopping gasket is disposed between the other mushroom head and the ratchet.

7. The crank mechanism of claim 1, wherein the crank head consists of a liner made of plastics and a jacket made of natural rubber;

the liner has a connecting counter bore running through the liner, and the crank rod correspondingly has an internal thread hole at the bottom thereof;

a blanking cover is sheathing on the outer end of the connecting counter bore; the crank head is mounted on the crank rod by passing a bolt through the connecting counter bore and screwing it into the internal thread hole.

* * * * *